US010472799B2

(12) United States Patent
Smith et al.

(10) Patent No.: US 10,472,799 B2
(45) Date of Patent: Nov. 12, 2019

(54) ATTACHMENT ASSEMBLY FOR CLAMPING BUCKETS AND SYSTEMS AND METHODS THEREOF

(71) Applicant: Caterpillar Inc., Peoria, IL (US)

(72) Inventors: Sage F. Smith, Apex, NC (US); Eve L. Rowshanaee, Apex, NC (US); Jacob C. Combs, Mooresville, NC (US)

(73) Assignee: Caterpillar Inc., Peoria, IL (US)

( * ) Notice: Subject to any disclaimer, the term of this patent is extended or adjusted under 35 U.S.C. 154(b) by 314 days.

(21) Appl. No.: 15/352,320

(22) Filed: Nov. 15, 2016

(65) Prior Publication Data

US 2018/0135276 A1 May 17, 2018

(51) Int. Cl.

| | |
|---|---|
| ***E02F 3/96*** | (2006.01) |
| ***E02F 3/34*** | (2006.01) |
| ***E02F 3/40*** | (2006.01) |
| ***E02F 3/407*** | (2006.01) |

(52) U.S. Cl.

CPC ..... *E02F 3/961* (2013.01); *E02F 3/3414* (2013.01); *E02F 3/404* (2013.01); *E02F 3/407* (2013.01); *E02F 3/962* (2013.01)

(58) Field of Classification Search

CPC ... E02F 3/96; E02F 3/961; E02F 3/962; E02F 3/404; E02F 3/3414; E02F 3/407

See application file for complete search history.

(56) References Cited

U.S. PATENT DOCUMENTS

| | | | | |
|---|---|---|---|---|
| 3,864,793 | A * | 2/1975 | Guest | E02F 3/962 24/569 |
| 6,287,070 | B1 * | 9/2001 | Perry | B66F 9/12 414/620 |
| 6,493,967 | B2 | 12/2002 | Holmes et al. | |
| 6,523,284 | B1 * | 2/2003 | Clugston | E02F 3/404 172/250 |
| 6,526,678 | B2 * | 3/2003 | Waddington, Jr. | E02F 3/404 172/811 |
| 6,990,758 | B1 * | 1/2006 | Holmes | E02F 3/962 172/252 |
| 7,226,268 | B2 * | 6/2007 | Gustafson | A01B 59/002 37/406 |

(Continued)

OTHER PUBLICATIONS

Smart Bar, Wesley Rae Investments, available at http://www.wesleyrae.com/smart-bar (last accessed Nov. 15, 2016).

*Primary Examiner* — Jessica H Lutz

(74) *Attorney, Agent, or Firm* — Oblon, McClelland, Maier & Neustadt

(57) ABSTRACT

An attachment assembly configured to be removably coupled between a first jaw and a second jaw of a clamping bucket. The attachment assembly includes a pair of sidewalls spaced from each other in a first direction and at least two structural beams spaced from each other in a second direction. Each of the first sidewall and the second sidewall includes a first connection interface configured to be removably coupled between the front jaw and the rear jaw, a retention arm configured to interconnect to a back surface of the rear jaw, and a second connection interface configured to interface with a working tool. The attachment assembly can also include a reaction arm configured to be arranged adjacent a bottom surface of the front jaw of the clamping bucket.

20 Claims, 6 Drawing Sheets

(56) References Cited

U.S. PATENT DOCUMENTS

| | | | | |
|---|---|---|---|---|
| 2001/0045031 | A1* | 11/2001 | Holmes | E02F 3/962<br>37/407 |
| 2001/0048873 | A1* | 12/2001 | Perry | B66F 9/12<br>414/724 |
| 2003/0228210 | A1* | 12/2003 | Friedland | B66F 9/12<br>414/724 |
| 2006/0239810 | A1* | 10/2006 | Penza | E02F 3/962<br>414/723 |
| 2007/0289172 | A1* | 12/2007 | Bridges | E02F 3/962<br>37/403 |
| 2008/0053674 | A1* | 3/2008 | Frederick | E02F 3/8152<br>172/684.5 |
| 2014/0373400 | A1* | 12/2014 | Sheehan | E02F 9/2883<br>37/403 |
| 2017/0254047 | A1* | 9/2017 | Kortesalmi | B60P 3/062 |

* cited by examiner

ATTACHMENT ASSEMBLY FOR CLAMPING BUCKETS AND SYSTEMS AND METHODS THEREOF

TECHNICAL FIELD

The present disclosure relates to clamping buckets, and more particularly to an attachment assembly configured to be removably coupled between jaws of clamping buckets, and systems and methods thereof.

BACKGROUND

Machines, such as loaders and excavators having clamping buckets or the like, may be employed at a worksite to perform a variety of operations. In certain situations, it may be necessary for the clamping bucket of such machines to be uncoupled from an actuator or actuators (e.g., hydraulic cylinders) to connect another working tool to the machine. However, uncoupling the clamping bucket and the actuator(s) may be undesirable for a variety of reasons. In some applications, the actuator(s) may not be strong enough to maintain a working tool between the jaws of the clamping bucket, particularly when the machine is backing up with the working tool in use.

U. S. Patent Pub. No. 2014/0373400, hereinafter the '400 publication, describes a wear pad assembly for mounting on a tool comprising first and second elements that are movable relative to each other from an open position to a closed position. According to the '400 publication, the wear pad assembly comprises a wear-resistant pad and a mounting bracket configured for attachment to the wear-resistant pad. The mounting bracket is configured to enable secure clamping between the first and second elements of the tool when in the closed position.

SUMMARY OF THE DISCLOSURE

In one aspect of the present disclosure, a loader is provided. The loader includes a frame coupled to a traction system configured to move the loader forward and backward. The loader includes at least one lift arm having a first end coupled to the frame. The loader also includes a multipurpose bucket coupled to a second end of the at least one lift arm. The multipurpose bucket has a front jaw and a rear jaw, where the front jaw is rotatable relative to the rear jaw about an axis. The loader further includes an actuator operatively coupled to the front jaw to rotate the front jaw relative to the rear jaw about the axis. The loader also includes an attachment assembly removably coupled between the front jaw and the rear jaw such that the attachment assembly is removable from between the front jaw and the rear jaw and only responsive to control of the actuator to separate the front and rear jaws. The loader further includes a working tool coupled to the attachment assembly such that a portion of the working tool extends below the attachment assembly.

The attachment assembly includes a pair of sidewalls spaced from each other in a first direction, and at least two structural beams spaced from each other in a second direction perpendicular to the first direction. Each of the at least two structural beams has a length greater than a width, a first end fixed to a first sidewall of the pair of sidewalls, and a second end fixed to a second sidewall of the pair of sidewalls. Each of the first sidewall and the second sidewall of the attachment assembly includes a first connection interface configured to be removably coupled between the front jaw and the rear jaw, an L-shaped retention arm configured to interconnect to a back surface of the rear jaw when the first connection interface is removably coupled between the front jaw and the rear jaw, an angled reaction arm arranged adjacent to a bottom surface of the front jaw when the first connection interface is removably coupled between the front jaw and the rear jaw, and a second connection interface configured to be coupled to the working tool.

In a side view of the attachment assembly, the first connection interface and the L-shaped retention arm of each of the first sidewall and the second sidewall are separated by a first engagement slot, and a bottom edge of the rear jaw is provided in the first engagement slot when the first connection interface is removably coupled between the front jaw and the rear jaw. Further, in the side view of the attachment assembly, the first connection interface and the angled reaction arm of each of the first sidewall and the second sidewall are separated by a second engagement slot, where an inner edge of the front jaw is provided in the second engagement slot when the first connection interface is removably coupled between the front jaw and the rear jaw.

In another aspect of the present disclosure, an attachment assembly configured to be removably coupled between a first jaw and a second jaw of a clamping bucket is provided. The attachment assembly comprises a body having a first outer surface facing a first direction and a second outer surface facing a second direction opposite the first direction, and including a center portion between the first outer surface and the second outer surface. The body further includes a first connection interface configured to be removably coupled between the front jaw and the rear jaw, a retention arm configured to interconnect to a back surface of the rear jaw, and a second connection interface configured to interface with a working tool.

In yet another aspect of the present disclosure, an attachment assembly configured to be removably coupled between a first jaw and a second jaw of a bucket is provided. The attachment assembly includes a body portion and a connection interface extending from the body portion in a first direction. The connection interface is configured to be coupled between the front jaw and the rear jaw. The attachment assembly also includes a retention arm extending from the body portion in a second direction different from the first direction. The retention arm is configured to be removably engaged with the rear jaw. The attachment assembly also includes a reaction arm that extends from the body portion in a third direction which is opposite the second direction.

Other features and aspects of this disclosure will be apparent from the following description and the accompanying drawings.

BRIEF DESCRIPTION OF THE DRAWINGS

The accompanying drawings, which are incorporated in and constitute a part of the specification, are illustrative of one or more embodiments and, together with the description, explain the embodiments. The accompanying drawings have not necessarily been drawn to scale. Further, any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figure 1:
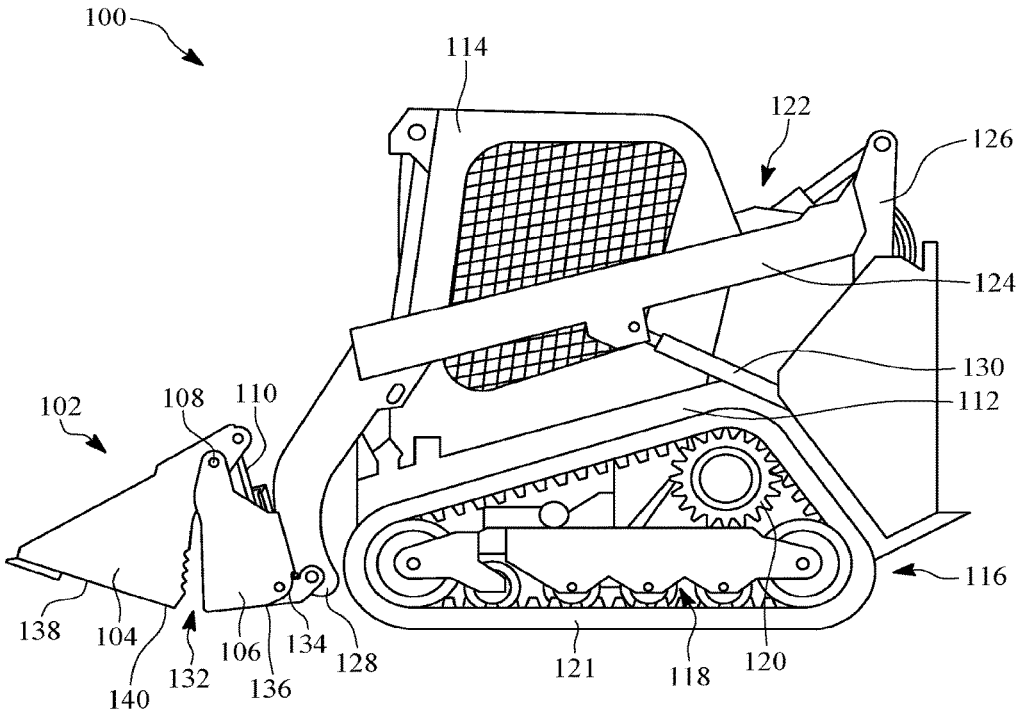
FIG. 1 is a side view of a loader having a bucket, according to one or more embodiments of the present disclosure.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Generally speaking, embodiments of the disclosed subject matter involve an attachment assembly configured to be removably coupled between jaws of a bucket, such as a multipurpose bucket, of a machine. The machine may be a loader or an excavator, for instance. Attachment assemblies according to embodiments of the disclosed subject matter may provide a single working tool, or, alternatively, enable connection of multiple different working tools to the attachment assembly, such as another bucket, a scarifier, a landplane, an aerator, a tow hitch, a harrow, a trench compactor, a trench backfiller, an asphalt screed, a manure scraper, and a plow.

FIG. 1 illustrates a side view of a loader 100, which may have a bucket 102, according to one or more embodiments of the present disclosure.

In one embodiment, the loader 100 may be a track loader, such as illustrated in FIG. 1. Further, although embodiments of the present disclosure are described herein in relation to the loader 100, the present disclosure is not limited to loaders, let alone track loaders, and may be equally applicable to other types of loaders, such as backhoe loaders, skid loaders, tractor front loaders, compact wheel loaders, small wheel loaders, and medium wheel loaders, as well as other types of machines, such as excavators. Thus, in general, the present disclosure may be applicable to any machine that may include a bucket having a first element and a second element movably connected relative to each other to achieve a jaw-like arrangement.

In the illustrated embodiment, the bucket 102 may be a multipurpose bucket, which may mean that the bucket 102 may be implemented as multiple different working tools, such as a bucket, a grapple, a grater, and a back dragging tool. Further, the bucket 102 may be a clamping bucket, such as a clam shell clamping bucket. In context of the present disclosure, the terms "multipurpose bucket," "clamping bucket," "MP bucket," "machine bucket," and "Multi-Purpose machine bucket" may be hereinafter interchangeably referred to as "the bucket."

The bucket 102 may include a front jaw 104 and a rear jaw 106. Further, one or more of the front jaw 104 and the rear jaw 106 may be configured (or reconfigured) to engage with a work surface or object (not shown) for performing operations, such as grappling, loading, grating, scooping, scrapping, pushing, grabbing, collecting, holding and conveying material and/or the work object at a worksite (not shown).

The front jaw 104 may be pivotally connected to the rear jaw 106 through at least one axle in the form of at least one pin 108, for instance. Owing to the pivotal coupling between the front jaw 104 and the rear jaw 106, the front jaw 104 may be rotatable relative to the rear jaw 106, or vice versa, about an axis at the at least one pin 108 to provide a jaw-like arrangement, for instance. The loader 100 may further include at least one actuator 110 (which may be comprised of one or more hydraulic cylinders, for example) operatively coupled to the front jaw 104 and/or the rear jaw 106 to rotate the front jaw 104 about the axis relative to the rear jaw 106, or vice versa. The at least one actuator 110 may be configured to selectively rotate the front jaw 104 relative to the rear jaw 106 based on one or more inputs from an operator of the loader 100 using one or more control interfaces of the loader 100. As illustrated in FIG. 1 and discussed in more detail with respect FIG. 3 and FIG. 4, the front jaw 104 may have a bottom surface 138 and an inner edge 140, and the rear jaw 106 may have a bottom edge 136.

Still referring to FIG. 1, the loader 100, in general, may include a frame 112 and an operator cab 114 mounted on the frame 112. The operator cab 114 may include control interfaces (not shown), such as a joystick and/or lever to control movement of the bucket 102, including movement of the bucket 102 based on movement of at least one lifting arm 124 of a lifting assembly 122 and/or movement of the front jaw 104 and the rear jaw 106 relative to each other.

The frame 112 may be coupled to a traction system 116 configured to move the loader 100 forward and backward. The traction system 116 may include a power source (not shown) supported on the frame 112 and a set of ground engaging members 118 on which the frame 112 may be disposed. The power source may be any suitable power source, such as an internal combustion engine, an electric motor, a power storage device including batteries, a hybrid engine, or a combination of two or more of the foregoing power sources. Generally speaking, the power source may be configured to provide power to the loader 100 for operational and mobility requirements. To move the loader 100 forward and backward, the power source may be coupled to one or more sprockets 120. The sprockets 120 may receive power from the power source and propel the set of ground engaging members 118. In the illustrated embodiment, the set of ground engaging members 118 may include tracks. In an alternative embodiment, the set of ground engaging members 118 may include wheels. In yet another embodiment, the set of ground engaging members 118 may include a combination of wheels and tracks.

The loader 100 may also include a lifting assembly 122 coupled to the frame 112 to move the bucket 102 relative to the frame 112. The lifting assembly 122 may include at least one lift arm 124 having a first end 126 coupled to the frame 112 and a second end 128 coupled to the bucket 102 either directly or indirectly. In an embodiment, the first end 126 of the at least one lift arm 124 may be coupled at a rear end portion of the frame 112, such as illustrated in FIG. 1. In an alternative embodiment, the first end 126 of the at least one lift arm 124 may be coupled at a front end portion of the frame 112. In an embodiment, the second end 128 of the at least one lift arm 124 may be pivotally coupled to the rear jaw 106 of the bucket 102 such that the bucket 102 may be tilted with respect to the at least one lift arm 124. In another embodiment, the second end 128 of the at least one lift arm 124 may be fixedly coupled to the rear jaw 106 the bucket 102 such that the bucket 102 may not be tilted relative to the at least one lift arm 124.

Further, the at least one lift arm 124 may be pivotally connected to the frame 112 such that the bucket 102 may be raised and/or lowered with respect to the work surface for performing various operations. In an embodiment, the lifting assembly 122 may include at least one lifting cylinder, such as at least one lifting actuator 130, configured to effectuate movement of the at least one lift arm 124 to move the bucket 102 with respect to the work surface. In an example, the at least one lifting actuator 130 may be controlled responsive to a received operator command input using one or more of the control elements that may be present within the operator cab 114, to effectuate movement of the at least one lift arm 124. In an example, the at least one actuator 110 may be selectively actuated using one or more control interfaces in the operator cab 114, for instance, to rotate the front jaw 104 relative to the rear jaw 106 to define an opening 132 to receive an attachment assembly according to embodiments of the disclosed subject matter between the front jaw 104 and the rear jaw 106 of the bucket 102. Also, the at least one actuator 110 may be selectively actuated to rotate the front jaw 104 away from the rear jaw 106, for example, to disengage the attachment assembly according to embodiments of the disclosed subject matter from the bucket 102.

Figure 2:
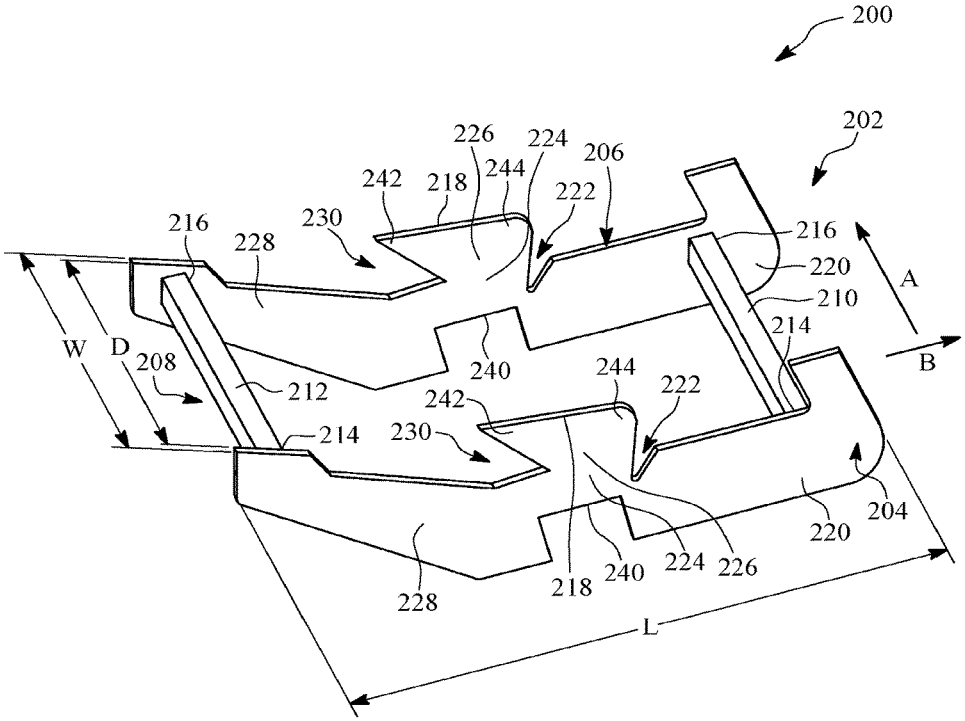
FIG. 2 is a side, overhead perspective view of an attachment assembly according to one or more embodiments of the present disclosure.

FIG. 2 illustrates a side, overhead perspective view of an attachment assembly 200 according to one or more embodiments of the present disclosure.

The attachment assembly 200 may be configured to be removably coupled between the front jaw 104 and the rear jaw 106 of the bucket 102. In an embodiment, the attachment assembly 200 may be removably coupled between the front jaw 104 and the rear jaw 106 such that the attachment assembly 200 may be removable from between the front jaw 104 and the rear jaw 106 only responsive to control of the at least one actuator 110 to separate the front jaw 104 and the rear jaw 106.

The attachment assembly 200, as shown in FIG. 2, may have a length 'L' and a width 'W'. In an embodiment, the length of the attachment assembly 200 may be greater than the width 'W' of the attachment assembly 200. In alternative embodiments, however, the length of the attachment assembly 200 may be less than or equal to the width 'W' of the attachment assembly 200.

The attachment assembly 200 may include a pair of sidewalls 202, including a first sidewall 204 and a second sidewall 206, which may be spaced apart from each other in a first direction 'A'. In an embodiment, the first sidewall 204 and the second sidewall 206 may be parallel to one another and spaced apart from each other in the first direction 'A'. In such an embodiment, the first sidewall 204 may be disposed at a distance 'D' from the second sidewall 206. The distance 'D' may be determined based on a shape, a dimension and/or a geometry of the bucket 102, and may vary for different types of the bucket 102 and/or the loader 100. In one or more embodiments, the second sidewall 206 and the first sidewall 204 may respectively have a first outer surface facing in the first direction and a second outer surface facing in a second direction opposite the first direction.

The attachment assembly 200 may also include at least one structural member 208, which may be or include at least two structural beams in the form of a first structural beam 210 and a second structural beam 212. Alternatively, the at least one structural member 208 may consist of or include only one structural member, i.e., a center portion, that extends between the first sidewall 204 and the second sidewall 206, in which case the center portion may define the second sidewall 206 with the first outer surface facing in the first direction and the first sidewall 204 with the second outer surface facing in the second direction opposite the first direction.

In the case of two structural members, such as first structural beam 210 and second structural beam 212, such members may be spaced apart from each other in a second direction 'B'. Optionally, the second direction 'B' may be perpendicular to the first direction 'A'. In the illustrated embodiment, the at least one structural member 208 may include the first structural beam 210 and the second structural beam 212, as noted above. In other embodiments, the at least one structural member 208 may include only one structural member, such as only one structural beam, or more than two structural members, such as more than two structural beams. In an embodiment, the first structural beam 210 and the second structural beam 212 may be integrally formed or formed in one piece with the first sidewall 204 and the second sidewall 206. In other embodiments, the first structural beam 210 and the second structural beam 212 may be coupled to the first sidewall 204 and the second sidewall 206 by various coupling options, such as fasteners (e.g., clamps, bolts, openings in the respective sidewalls) and/or welding.

In an embodiment, each of the first structural beam 210 and the second structural beam 212 may have geometries in the form of a rectangular cuboid, a plate, or a volumetric cylinder, for instance. In an embodiment, each of the first structural beam 210 and the second structural beam 212 may have a length greater than a width and/or a thickness. Further, each of the first structural beam 210 and the second structural beam 212 may include a first end 214 fixedly or removably coupled to the first sidewall 204, and a second end 216 fixedly or removably coupled to the second sidewall 206. In other words, each of the first structural beam 210 and the second structural beam 212 may extend from at least the first sidewall 204 to at least the second sidewall 206. Optionally, in one or more embodiments, the first end 214 of each of the first structural beam 210 and the second structural beam 212 may extend into the first sidewall 204. Likewise, optionally, in one or more embodiments, the second end 216 of each of the first structural beam 210 and the second structural beam 212 may extend into the second sidewall 206.

Each of the first sidewall 204 and the second sidewall 206 may include a first connection interface 218 configured to be removably coupled between the front jaw 104 and the rear jaw 106 of the bucket 102. In an example, for each of the first sidewall 204 and the second sidewall 206, the first connection interface 218 may have a substantially triangular shape (also referred to as "triangle-shaped portion") in a side view of the attachment assembly 200, such as a side plan view of the attachment assembly 200. Further, in one or more embodiments, in the side plan view of the attachment assembly 200, for instance, for each of the first sidewall 204 and the second sidewall 206, the first connection interface 218 may form a non-rounded corner 242 on a first side facing in a direction toward the front jaw 104 and a rounded corner 244 on a second side opposite the first side of the first connection interface 218. The non-rounded corner 242, may form a point, such as illustrated in FIG. 2, for instance.

Figure 4:
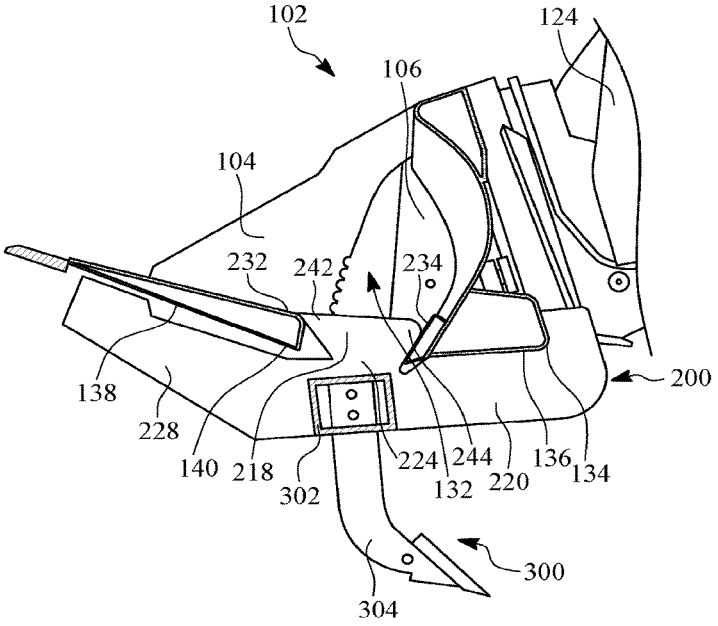
FIG. 4 is a sectional side view showing the attachment assembly of FIG. 3 coupled between the first jaw and the second jaw of the bucket, according to one or more embodiments of the present disclosure.

Each of the first sidewall 204 and the second sidewall 206 may also have a retention arm 220 configured to interconnect to a back surface 134 of the rear jaw 106 of the bucket 102 when the first connection interface 218 is removably coupled between the front jaw 104 and the rear jaw 106. The retention arm 220 may also abut or be provided adjacent to the bottom edge 136 of the rear jaw 106. Optionally, the retention arm 220 may have an L-shape, such as shown in FIG. 2 and FIG. 4, and thus may be referred to as an "L-shaped" retention arm.

In one or more embodiments, each of the first sidewall 204 and the second sidewall 206 may include a body portion 224 from which the first connection interface 218 and the retention arm 220 may extend. In reference to FIG. 3, for instance, the first connection interface 218 may extend from the body portion 224 in a first direction 'C' and the retention arm 220 may extend from the body portion 224 in a second direction 'E'. Further, the body portion 224 may include a neck portion 226 that defines a first slot 222 between the first connection interface 218 and the retention arm 220. The term "first slot" may be used interchangeable with "first engagement slot."

Figure 3:
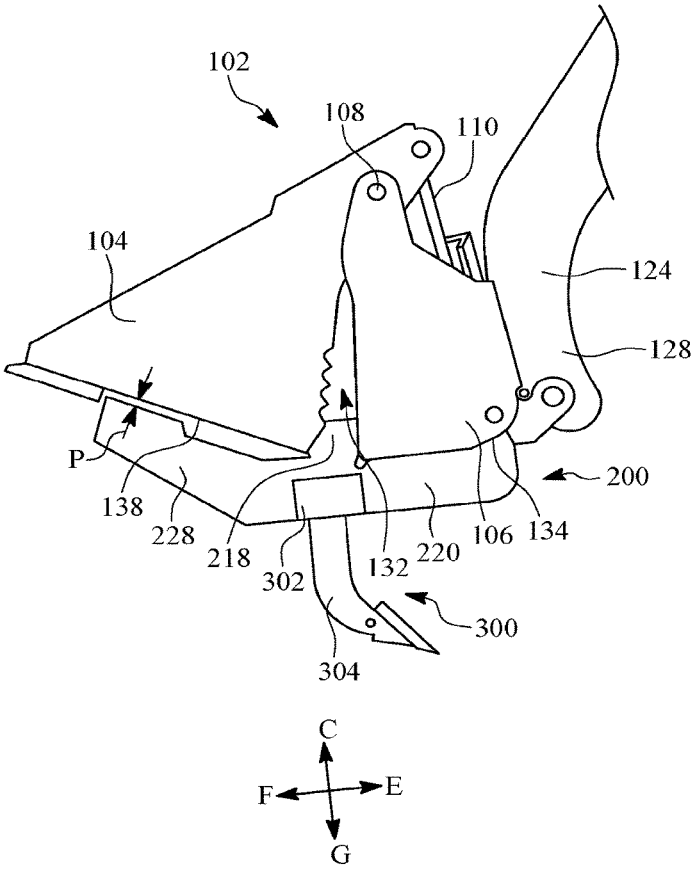
FIG. 3 is a side plan view of an attachment assembly according to one or more embodiments of the present disclosure coupled between a first jaw and a second jaw of the bucket of the loader of FIG. 1.

In one or more embodiments, each of the first sidewall 204 and the second sidewall 206 may additionally or optionally include a reaction arm 228, which may extend from the body portion 224 in a third direction 'F' opposite the second direction 'E' as shown in FIG. 3, for instance. Reaction arm 228 may be configured to be arranged adjacent to the bottom surface 138 of the front jaw 104 when the first connection interface 218 is removably coupled between the front jaw 104 and the rear jaw 106 of the bucket 102. In an example, the reaction arm 228 may be "angled," that is, at an angle relative to the retention arm 220. For example, in one or more embodiments, in a side view of the attachment assembly 200, for instance, a side plan view, the retention arm 220 and the reaction arm 228 may form an obtuse angle. Reaction arm 228 may be hereinafter interchangeably referred to as an "angled reaction arm."

In one or more embodiments, each of the first sidewall 204 and the second sidewall 206 may include a second connection interface 240 configured to be coupled, removably or fixedly, to a working tool, such as a working tool 300 of FIG. 3 and FIG. 4, or a working tool 500 of FIG. 5, which is discussed in more detail below.

In one or more embodiments, the connection interface 218 and the retention arm 220 of each of the first sidewall 204 and the second sidewall 206 may be separated by the first slot 222. Additionally or alternatively, in one or more embodiments, for each of the first sidewall 204 and the second sidewall 206, the first connection interface 218 and the reaction arm 228 may be separated by a second slot 230, which may be referred to herein as a "second engagement slot." In an embodiment, the second slot 230 may be wider than the first slot 222. For example, the second slot 230 may define an angle greater than an angle of the first slot 222, in the side plan view of the attachment assembly 200. In an embodiment, the second slot 230 of each of the first sidewall 204 and the second sidewall 206 may be defined by the neck portion 226.

Though FIG. 2 illustrates two distinct sidewalls, that is, the first sidewall 204 and the second sidewall 206, attachment assemblies according to alternative embodiments may have only one connection interface 218 that extends from the first sidewall 204 to the second sidewall 206. For example, an attachment assembly may be formed as one piece, with a body having a first outer surface facing a first direction and a second outer surface facing a second direction opposite the first direction, and including a center portion between the first outer surface and the second outer surface. The body may include only one connection interface 218 that runs from the first outer surface to the second outer surface, for instance. Likewise, the body may include only one retention arm 220, which may run from the first outer surface to the second outer surface, for instance, that is configured to interconnect to the back surface 134 of the rear jaw 106. Optionally, the body may have only one connection interface 240, which may run from the first outer surface to the second outer surface, for instance, that is configured to interface with one or more working tools (though, of course, the "only one" connection interface 240 may have multiple connection points to the working tool). Alternatively, the body may include the working tool. That is, the working tool may be formed in one piece with the body.

FIG. 3 and FIG. 4 illustrate a side plan view and a sectional side plan view, respectively, of a variation of the attachment assembly 200 removably coupled between the front jaw 104 and the rear jaw 106 of the bucket 102, according to one or more embodiments of the present disclosure.

Notably, the variation of the attachment assembly 200 of FIG. 3 and FIG. 4 may include a working tool 300. The working tool 300 in FIG. 3 and FIG. 4 is shown as a scarifier, which may be comprised of a scarifier bar 302 and a plurality of scarifier teeth 304. However, working tools according to embodiments of the disclosed subject matter are not so limited. For example, working tools according to embodiments of the disclosed subject matter may be any of a landplane, an aerator, a tow hitch, a harrow, a trench compactor, a trench backfiller, an asphalt screed, a manure scraper, a plow, and another bucket.

Optionally, working tools according to embodiments of the disclosed subject matter may not be connectable to the at least one actuator 110. Thus, it may not be necessary to disconnect the at least one actuator 110 to release the attachment assembly from the grasp of the first front jaw 104 and the rear jaw 106 of the bucket 102, or to disassociate the attachment assembly from the loader 100. Additionally or alternatively, working tools according to one or more embodiments of the disclosed subject matter may be static working tools in that the working tools have no moving parts, that is, have no parts that move relative to any other part or parts thereof.

The working tool 300 may be provided relative to the attachment assembly 200 such that a portion or portions of the working tool 300 extend below the attachment assembly 200. In such embodiments, the working tool 300 may extend away from the body portion 224 in a fourth direction 'G' The fourth direction 'G' may be opposite the first direction 'C' and different from each of the second direction 'E' and the third direction 'F' in FIG. 3.

In one or more embodiments, the working tool 300 may be removably coupled to the attachment assembly 200, for example, by one or more fasteners (e.g., bolts, clamps, opposing openings in the pair of sidewalls 202, etc.). In another embodiment, the working tool 300 may be fixedly coupled to the attachment assembly 200 by welding or using rivets, for example, or formed in one piece with the attachment assembly 200 using an additive manufacturing process. Thus, in one or more embodiments of the disclosed subject matter, the attachment assembly 200 may be comprised of the working tool 300, or a portion thereof, such as the scarifier bar 302 in the case of working tool 300. As but one specific example, the second connection interface 240 may be welded to the scarifier bar 302 of the working tool 300 such that a portion of the plurality of scarifier teeth 304 extend below the attachment assembly 200. Further, optionally, the scarifier teeth 304 may be fixedly or removably coupled to the scarifier bar 302. Thus, in one or more embodiments, the scarifier teeth 304 may be removed from the scarifier bar 302 and replaced with different scarifier teeth (or some other working tool). For example, the scarifier bar 302 may be comprised of a plurality of slots to receive individual scarifier teeth, where each of the scarifier teeth may be held in the respective slots by one or more pin and hole retention members.

Still referring to FIG. 3 and FIG. 4, when the first connection interface 218 is removably coupled between the front jaw 104 and the rear jaw 106 of the bucket 102, a portion of the bottom edge 136 of the rear jaw 106 may be provided in the first slot 222 of each of the first sidewall 204 and the second sidewall 206 such that the retention arm 220 of each of the first sidewall 204 and the second sidewall 206 may interconnect with the back surface 134 of the rear jaw 106. That is, the retention arm 220 of each of the first sidewall 204 and the second sidewall 206 may latch or "hook" onto the back surface 134 of the rear jaw 106. Thus, the retention arm 220 of each of the first sidewall 204 and the second sidewall 206 may be configured to be removably engaged with the rear jaw 106. Further, a first portion of the first connection interface 218, for instance, a side edge thereof between the rounded corner 244 and the neck portion 226, may engage with a front surface 234 of the rear jaw 106.

Also, when the first connection interface 218 is removably coupled between the front jaw 104 and the rear jaw 106 of the bucket 102, for each of the first sidewall 204 and the second sidewall 206, the inner edge 140 of the front jaw 104 may be provided in the second slot 230. In this regard, note that FIG. 4 illustrates that the inner edge 140 is not fully seated in the second slot 230, whereas FIG. 3 illustrates that the inner edge 140 is fully seated in the second slot 230. Thus, FIG. 4 may illustrate an intermediate position for the inner edge 140 as the inner edge 140 is brought toward the fully seated position of FIG. 3. Further, a second portion of the first connection interface 218, for instance, a side edge thereof between the non-rounded corner 242 and the neck portion 226, may engage with a rear surface 234 of the front jaw 104. In an embodiment, the inner edge 140 of the front jaw 104 may be provided in the second slot 230 of each of the first sidewall 204 and the second sidewall 206 such that a clearance 'P' may be defined between the bottom surface 138 of the front jaw 104 and each reaction arm 228. In another embodiment, when the first connection interface 218 is removably coupled between the front jaw 104 and the rear jaw 106 of the bucket 102, for each of the first sidewall 204 and the second sidewall 206, the inner edge 140 of the front jaw 104 may be provided in the second slot 230 such that the reaction arm 228 contacts the bottom surface 138 of the front jaw 104. In various embodiments, each reaction arm 228 may be configured to limit or prevent rotation of the attachment assembly 200 with respect to the bucket 102 when the attachment assembly 200 is removably coupled between the front jaw 104 and the rear jaw 106 of the bucket 102 in the fully seated arrangement of FIG. 3, for instance, particularly when a corresponding working tool, such as working tool 300, is being applied to a working surface.

In one or more embodiments, to couple the attachment assembly 200 between the front jaw 104 and the rear jaw 106, the first connection interface 218 of each of the first sidewall 204 and the second sidewall 206 may be removably coupled between the front jaw 104 and the rear jaw 106 by rotating the front jaw 104 towards the rear jaw 106. The clearance 'P' between each reaction arm 228 and the front jaw 104 may allow rotation of the front jaw 104 into the second engagement slot 230 when the attachment assembly 200 is being coupled between the front jaw 104 and the rear jaw 106 of the bucket 102. In an example, the clearance 'P' may be a value between ½ inches to 1 inch, for example.

Figure 5:
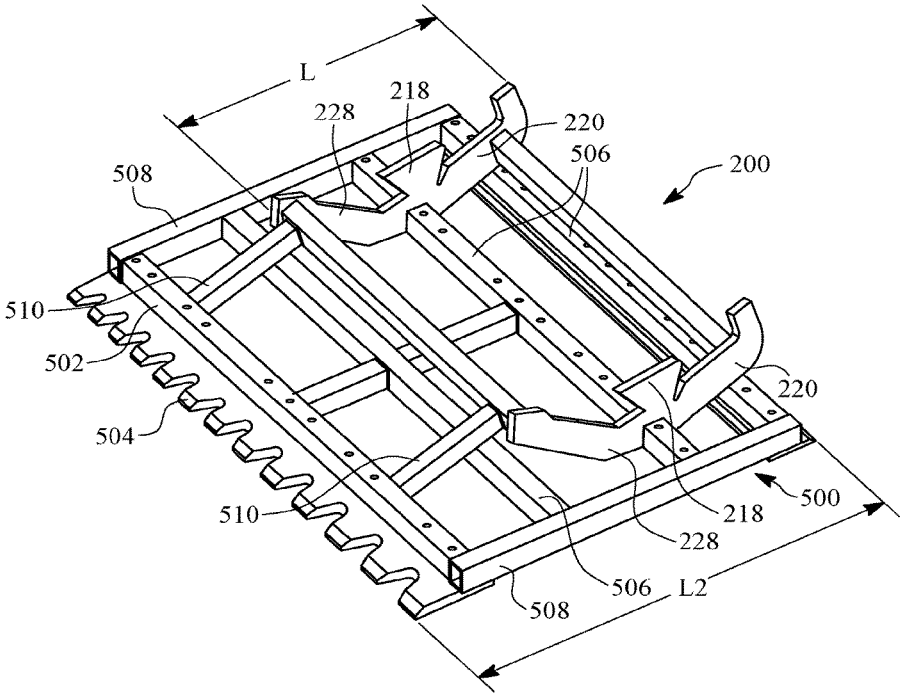
FIG. 5 is an overhead perspective view of an attachment assembly according to one or more embodiments of the present disclosure.

FIG. 5 is an overhead perspective view of a variation of the attachment assembly 200, which is illustrated as being coupled to a working tool 500, according to one or more embodiments of the present disclosure.

The attachment assembly 200 illustrated in FIG. 5 may be removably or fixedly coupled to working tool 500 via the second connection interface 240, such as described above. Thus, in one or more embodiments, the working tool 300 from FIG. 3 and FIG. 4 may be removed from the attachment assembly 200 and replaced with the working tool 500 or vice versa. Alternatively, in one or more embodiments, the working tool 500 may be permanently coupled or formed in one piece with the attachment assembly 200, and thus, the attachment assembly 200 may be interpreted as being comprised of the working tool 500. Of course, even in embodiments where the working tool (e.g., working tool 300 or working tool 500) are removably coupled to the attachment assembly 200, the attachment assembly 200 may still be interpreted as being comprised of the working tool.

In FIG. 5, the working tool 500 is illustrated as a landplane, which may be used to level a working surface, for instance. The working tool 500 may have a length 'L2' greater than the length 'L' of the attachment assembly 200. The working tool 500 may include an implement connecting beam 502 having or coupled to a plurality of teeth 504, and a plurality of connecting beams 506 (FIG. 5 illustrates three connecting beams) laterally spaced from the implement connecting beam 502. The working tool 500 may also include a pair of side beams 508 running from opposite ends the implement connecting beam 502 to opposite ends of an outermost connecting beam 506 of the plurality of connecting beams 506. Additionally or alternatively, the implement connecting beam 502 may be connected to one or more of the at least one structural member 208 of the attachment assembly 200 through one or more extending beams 510.

It may be contemplated that the shape, geometry and construction of each of the working tools 300 and 500 shown in FIGS. 1-5 are merely exemplary and not limiting to the scope of the present disclosure. Further, the second connection interface 240 is merely exemplary and not limiting to the scope of the present disclosure, meaning that the second connection interface 240 may have a shape different from those shown in FIG. 3 and FIG. 4.

Figure 6:
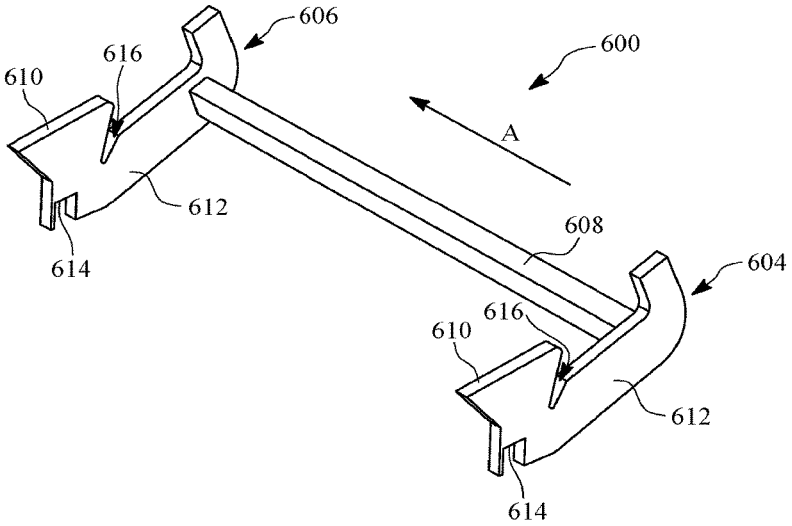
FIG. 6 is an overhead perspective view of an attachment assembly according to one or more embodiments of the present disclosure.

FIG. 6 is an overhead perspective view of an attachment assembly 600 according to one or more embodiments of the present disclosure. Notably, the attachment assembly 600 may not include any reaction arms.

In FIG. 6, the attachment assembly 600 may include a pair of sidewalls including a first sidewall 604 and a second sidewall 606, which may be spaced from each other in the first direction 'A'. The attachment assembly 600 may also include a structural beam 608 extending from the first sidewall 604 to the second sidewall 606. Each of the first sidewall 604 and the second sidewall 606 may include a first connection interface 610 configured to be removably coupled between the front jaw 104 and the rear jaw 106 of the bucket 102, and a retention arm 612 configured to interconnect to the back surface 134 of the rear jaw 106.

Each of the first sidewall 604 and the second sidewall 606 may also include a second connection interface 614 configured to interface with a working tool (not shown), such as discussed above with respect to FIGS. 2-5. Thus, the working tool may be fixedly or removably coupled to the attachment assembly 600 as discussed above with respect to FIGS. 2-5. Further, in one or more embodiments, the attachment assembly 600 may be comprised of the working tool, whether the working tool is removably coupled to, fixedly coupled to or formed in one piece with the attachment assembly 600.

In a side view of the attachment assembly 600, for example, a side plan view, the first connection interface 610 and the retention arm 612 of each of the first sidewall 604 and the second sidewall 606 may be separated by a first engagement slot 616, in which a portion of the bottom edge 136 and a portion of the front surface 234 of the rear jaw 106 may be provided when the first connection interface 610 is removably coupled between the front jaw 104 and the rear jaw 106. Thus, the portion of the bottom edge 136 and the portion of the front surface 234 of the rear jaw 106 may be provided in the first engagement slot 616 of each of the first sidewall 604 and the second sidewall 606 such that the retention arm 612 of each of the first sidewall 604 and the second sidewall 606 may interconnect with the back surface 134 of the rear jaw 106. That is, the retention arm 612 of each of the first sidewall 604 and the second sidewall 606 may latch or "hook" onto the back surface 134 of the rear jaw 106 when the first connection interface 610 is removably coupled between the front jaw 104 and the rear jaw 106.

INDUSTRIAL APPLICABILITY

Embodiments of the present disclosure may pertain to attachment assemblies, such as attachment assembly 200 and attachment assembly 600, for attachment to buckets, such as clamping buckets, and systems and methods thereof. More specifically, embodiments of the present disclosure may relate to the attachment assembly 200 or the attachment assembly 600 which may be coupled between the front jaw 104 and the rear jaw 106 of the clamping bucket 102 to provide the option of multiple different working tools for the clamping bucket 102. Providing multiple different working tools for the clamping bucket 102, via one or more attachment assemblies according to embodiments of the disclosed subject matter, may not require disconnection of the at least one actuator 110.

The first connection interface 218, 610 of each of the first sidewall 204, 604 and second sidewall 206, 606 of the attachment assembly 200, may be grasped by the bucket 102, between the front jaw 104 and the rear jaw 106. In an embodiment, for each of the first sidewall 204, 604 and the second sidewall 206, 606, the first connection interface 218, 610 may include the non-rounded corner 242 that may engage with the front jaw 106 to pull the attachment assembly 200, 600 as the front jaw 104 rotates toward the rear jaw 106. Hence, the front jaw 104 may be rotated toward the rear jaw 106 such that the rear surface 232 of the front jaw 104 is fully seated in the second engagement slot 230, or positioned at the neck portion of the first connection interface 610, to removably (but fixedly) couple the attachment assembly 200, 600 between the front jaw 104 and the rear jaw 106 of the clamping bucket 102. Such coupling between the front jaw 104 and the rear jaw 106 may be so long as the operator of the loader 100 does not provide a command to separate the front jaw 104 and the rear jaw 106 to release the attachment assembly 200, 600. Further, for each of the first sidewall 204 and the second sidewall 206, the rounded corner 244 may define a tolerance gap between the rear jaw 106 and the first connection interface 218, 610 and the rear jaw 106. The tolerance gap may compensate for variations caused due to wearing of the bucket 102, for example, the front surface 234 of the rear jaw 106.

Further, when the first connection interface 218 of each of the first sidewall 204 and second sidewall 206 are removably coupled between the front jaw 104 and the rear jaw 106, the retention arm 220 of each of the first sidewall 204 and the second sidewall 206 may prevent undesired rotation of the front jaw 104 relative to the rear jaw 106. In various embodiments, the reaction arm 228 of each of the first sidewall 204 and second sidewall 206 may be provided to restrict or prevent rotation of the attachment assembly 200 relative to the front jaw 104 and the rear jaw 106. Thus, the reaction arm 228 of each of the first sidewall 204 and second sidewall 206 may prevent the bucket 102 from being opened by external forces applied to the working tool 300, 500 associated with the attachment assembly 200. The reaction arm 228 of each of the first sidewall 204 and second sidewall 206 may have an angled profile that may help in resisting rotational forces acting on the bucket 102.

With the use and implementation of attachment assemblies according to embodiments of the present disclosure, such as the attachment assemblies 200 and 600, the loader 100 may be used to perform a wide variety of different working operations without wholesale replacement of the bucket 102 with the working tool 300, or without removing actuator connections, for example. As one or more of working tools such as, a bucket, a scarifier, a landplane, an aerator, a tow hitch, a harrow, a trench compactor, a trench backfiller, an asphalt screed, a manure scraper, and a plow may be implemented with attachment assemblies according to embodiments of the disclosed subject matter, the present disclosure have wide applicability across industries. Further, the at least one actuator 110 may be selectively actuated to rotate the front jaw 104 away from the rear jaw 106 (or vice versa) to disengage the attachment assembly 200, 600 from the bucket 102. Therefore, coupling and decoupling of the attachment assembly 200, 600 from the bucket 102 may be carried out when the working tool 300, 500 is in air or on the ground.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A loader comprising:

a frame coupled to a traction system configured to move the loader forward and backward;

at least one lift arm having a first end coupled to the frame;

a multipurpose bucket coupled to a second end of the at least one lift arm, the multipurpose bucket having a front jaw and a rear jaw, the front jaw being rotatable relative to the rear jaw about an axis;

an actuator operatively coupled to the front jaw to rotate the front jaw relative to the rear jaw about the axis;

an attachment assembly removably coupled between the front jaw and the rear jaw such that the attachment assembly is removable from between the front jaw and the rear jaw only responsive to control of the actuator to separate the front and rear jaws, the attachment assembly including:

a pair of sidewalls spaced from each other in a first direction, and at least two structural beams spaced from each other in a second direction perpendicular to the first direction, each of the at least two structural beams having a length greater than a width, a first end fixed to a first sidewall of the pair of sidewalls, and a second end fixed to a second sidewall of the pair of sidewalls; and a working tool coupled to the attachment assembly such that a portion of the working tool extends below the attachment assembly, wherein each of the first sidewall and the second sidewall has:

a first connection interface configured to be removably coupled between the front jaw and the rear jaw, an L-shaped retention arm configured to interconnect to a back surface of the rear jaw when the first connection interface is removably coupled between the front jaw and the rear jaw;

an angled reaction arm arranged adjacent to a bottom surface of the front jaw when the first connection interface is removably coupled between the front jaw and the rear jaw; and a second connection interface configured to be coupled to the working tool, wherein, in a side view of the attachment assembly, the first connection interface and the L-shaped retention arm of each of the first sidewall and the second sidewall are separated by a first engagement slot, a bottom edge of the rear jaw being provided in the first engagement slot when the first connection interface is removably coupled between the front jaw and the rear jaw, and wherein, in the side view of the attachment assembly, the first connection interface and the angled reaction arm of each of the first sidewall and the second sidewall are separated by a second engagement slot, an inner edge of the front jaw being provided in the second engagement slot when the first connection interface is removably coupled between the front jaw and the rear jaw.

2. The loader of claim 1, wherein the working tool is one of a bucket, a scarifier, a landplane, an aerator, a tow hitch, a harrow, a trench compactor, a trench backfiller, an asphalt screed, a manure scraper, and a plow.

3. The loader of claim 1, wherein the working tool is removably coupled to the attachment assembly.

4. The loader of claim 1, wherein the working tool is formed in one piece with the attachment assembly.

5. The loader of claim 1, wherein, in the side view of the attachment assembly, for each of the first sidewall and the second sidewall, the L-shaped retention arm and the angled reaction arm form an obtuse angle.

6. The loader of claim 1, wherein the working tool has a first length and the attachment assembly has a second length, the first length being greater than the second length.

7. The loader of claim 1, wherein, in the side view of the attachment assembly, for each of the first sidewall and the second sidewall, the first connection interface forms a non-rounded corner on a first side facing the reaction arm and a rounded corner on a second side facing the L-shaped retention arm.

8. The loader of claim 1, wherein the working tool is not connectable to the actuator.

9. An attachment assembly configured to be removably coupled between a first jaw and a second jaw of a clamping bucket, the attachment assembly comprising:

a body having a first outer surface facing a first direction and a second outer surface facing a second direction opposite the first direction, and including a center portion between the first outer surface and the second outer surface, wherein the body further includes:

a first connection interface configured to be removably coupled between the front jaw and the rear jaw, a retention arm configured to interconnect to a back surface of the rear jaw, and a second connection interface configured to interface with a working tool, wherein, in a side view of the attachment assembly, a first engagement slot is provided at a first side of the first connection interface and a second engagement slot is provided at a second side of the first connection interface opposite the first side, wherein the first connection interface and the retention arm are separated by the first engagement slot, and wherein the second engagement slot is wider than the first engagement slot.

10. The attachment assembly of claim 9, wherein the body further includes a reaction arm that extends in a third direction, the retention arm extending in a fourth direction opposite the third direction.

11. The attachment assembly of claim 10, wherein, in the side view of the attachment assembly, the retention arm and the reaction arm form an obtuse angle.

12. The attachment assembly of claim 10, wherein, in the side view of the attachment assembly, the first connection interface and the reaction arm are separated by the second engagement slot.

13. The attachment assembly of claim 9, further comprising the working tool, wherein the working tool is removably connected to the second connection interface.

14. The attachment assembly of claim 9, wherein in the side view of the attachment assembly, the first connection interface is below the second connection interface.

15. The attachment assembly of claim 9, wherein the attachment assembly is configured to be removably coupled between the first jaw and the second jaw such that the first connection interface is between the first jaw and the second jaw and such that the second connection interface and the center portion of the body are below the first and second jaws in the side view of the attachment assembly.

16. An attachment assembly configured to be removably coupled between a first jaw and a second jaw of a bucket, the attachment assembly comprising:

a body portion;

a connection interface extending from the body portion in a first direction and configured to be coupled between the front jaw and the rear jaw;

a retention arm extending from the body portion in a second direction different from the first direction and configured to be removably engaged with the rear jaw; and a reaction arm that extends from the body portion in a third direction, the third direction being opposite the second direction, wherein the body portion includes a neck portion that defines a first slot between the retention arm and the connection interface and a second slot between the reaction arm and the connection interface.

17. The attachment assembly of claim 16, further comprising a working tool extending from the body portion in a fourth direction, the fourth direction being opposite the first direction and different from the second direction and the third direction.

18. The attachment assembly of claim 17, wherein the working tool is fixed to the body portion.

19. The attachment assembly of claim 16, wherein the attachment assembly has a length greater than a width.

20. The attachment assembly of claim 16, wherein, in a side view of the attachment assembly, the connection interface forms a non-rounded corner on a first side facing the reaction arm and a rounded corner on a second side facing the retention arm.

* * * * *